United States Patent [19]

Van Laar

[11] 4,371,334

[45] Feb. 1, 1983

[54] SHAFT FURNACE, PARTICULARLY THE REFRACTORY CONSTRUCTION OF THE BOTTOM THEREOF

[75] Inventor: Jacobus Van Laar, Santpoort, Netherlands

[73] Assignee: Estel Hoogovens BV, IJmuiden, Netherlands

[21] Appl. No.: 245,375

[22] Filed: Mar. 19, 1981

[30] Foreign Application Priority Data

Mar. 21, 1980 [NL] Netherlands ..... 8001669

[51] Int. Cl.[3] ..... F27D 1/08; C21B 7/08; F27D 1/14

[52] U.S. Cl. ..... 432/95; 266/197; 432/247; 432/252

[58] Field of Search ..... 432/95, 4, 252, 247; 266/197, 198

[56] References Cited

U.S. PATENT DOCUMENTS

| | | | |
|---|---|---|---|
| 2,423,898 | 7/1947 | McLain . | |
| 3,752,638 | 8/1973 | Van Larr et al. | 432/95 |
| 4,004,791 | 1/1977 | Saunders et al. | 266/197 |

*Primary Examiner*—John J. Camby
*Attorney, Agent, or Firm*—Jon M. Lewis

[57] ABSTRACT

The refractory bottom of a shaft furnace, e.g. a blast furnace has a graphite layer, above it an intermediate layer of lower coefficient of thermal conductivity (λ-value) and above the intermediate layer a third layer of yet lower λ-value. To control the penetration of molten metal into the bottom and in particular to achieve a stable location of the solidification isotherm in the intermediate layer, the material of the intermediate layer is one having a λ-value of 12 to 30 kcal/m.h. °C. This material may be semi-graphite. Such material does not undergo a change of λ-value when permeated by the molten metal.

9 Claims, 1 Drawing Figure

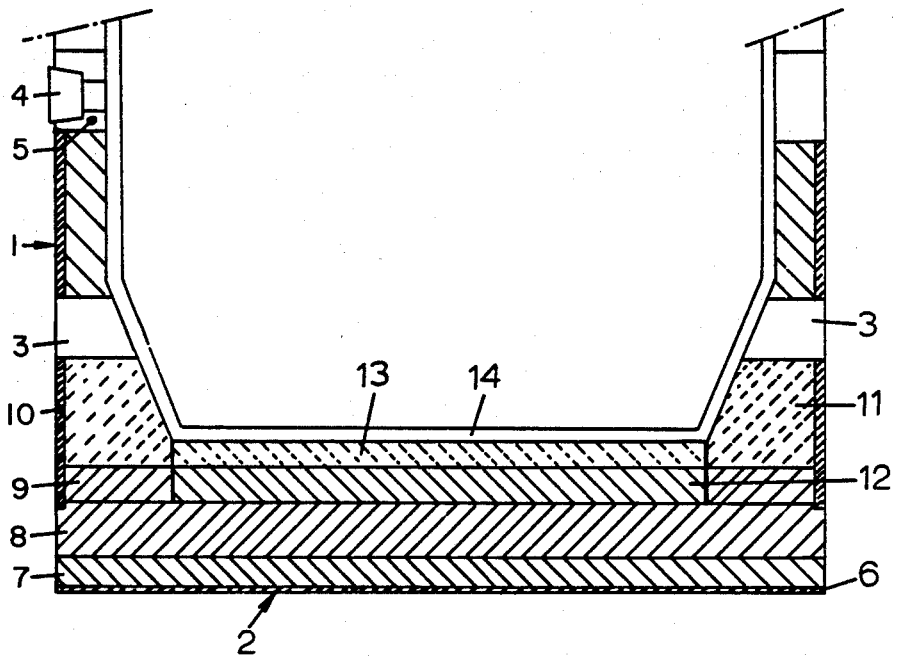
4
5
1
3
10
9
8
7
2
13
14
3
11
12
6

SHAFT FURNACE, PARTICULARLY THE REFRACTORY CONSTRUCTION OF THE BOTTOM THEREOF

BACKGROUND OF THE INVENTION

1. Field of the Invention

The invention relates to a metallurgical shaft furnace and in particular to the refractory construction of the bottom and the adjoining part of the hearth of a shaft furnace. The invention is especially applicable to blast furnaces.

2. Description of the Prior Art

U.S. Pat. No. 3,752,638 discloses a shaft furnace bottom having a graphite layer and, above the graphite layer, a layer of semi-graphite of coefficient of thermal conductivity (hereinafter referred to as the λ-value) of about 20 kcal/m.h.° C. This semi-grahite layer is the uppermost layer of the bottom. Graphite has a high λ-value of for example 90 kcal/m.h.° C. Below the graphite is a layer of carbon brick with λ-value of about 4 kcal/m.h.° C. In an alternative construction proposed in this patent the semi-graphite layer is replaced by a carbon layer with λ-value of 5 kcal/m.h.° C. covered by a magnesite layer having a λ-value of 2 to 3 kcal/m.h.° C.

However, it has been found that when the shaft furnace is a blast furnace for the reduction of iron from iron ore, the carbon-free covering layer is affected by the high temperature drop across it, so that liquid pig iron comes into contact with the carbon layer. This carbon layer is gradually impregnated from top to bottom with iron, so its coefficient of thermal conductivity (λ-value) tends to rise from about 4 to 5 to about 15 kcal/m.h.° C. As a result of this impregnation with liquid iron, and of the consequent increase in λ-value the locations of the isotherms in it change. This leads to wear and attack on the carbon layer with the result that the liquid iron also reaches the graphite layer in places. The graphite layer which is highly expensive, is then also gradually affected.

For this reason, repairs and partial replacement of the bottom structure may be necessary at heavy expense, particularly on graphite bricks, and additionally the campaign life of the furnace is reduced, which leads to loss of production.

SUMMARY OF THE INVENTION

The object of the present invention is to overcome these disadvantages and in particular to provide a furnace bottom construction which is stable in operation and therefore has a longer life.

The invention as claimed is intended to achieve this. Essentially, in the invention the material of the layer above the graphite layer and below the low-conductivity covering layer has a λ-value in the range 12 to 30, preferably 12 to 17 kcal/m.h.° C. Particularly, this material should be chosen so that its λ-value is not substantially altered when the material is penetrated by the molten metal. Some increase in λ-value may occur but this should be only slight.

The penetration by molten metal therefore affects the temperature gradient through the bottom only very slightly and consequently the position of the isotherms in the bottom varies, at most, only slightly.

With this construction, it has even been found to be possible with a conventional thickness of the graphite layer and with an acceptable thickness of the intermediate layer above the graphite layer from a structural point of view, for the bottom to be designed for viable cooling conditions so that the 1,000° C. isotherm is above the intermediate layer. This means that the so-called "melting isotherm" (solidification isotherm) lies within the covering layer of refractory material. Molten pig iron cannot therefore penetrate through this covering layer into the intermediate layer lying beneath it, while this intermediate layer in combination with the heat carried off by the graphite layer, ensures adequate cooling of the covering layer.

For this covering layer, which should be of high quality, a material such as firebrick (chamotte) with preferably an especially high $Al_2O_3$ content may be used.

Other materials such as for example magnesite brick may alternatively be used. In conventional materials, magnesite brick has a λ-value of about 3 to 4 kcal/m.h.° C. as against a λ-value of about 2 kcal/m.h.° C. for a high $Al_2O_3$ firebrick.

For the intermediate layer, carbonaceous material such as semi-graphite is preferred. Semigraphite is a known material obtained by partial graphitisation of carbon blocks. The graphitisation process, which is expensive in energy, is not fully completed but is stopped at a time such that the desired λ-value is obtained. Alternatively, semi-graphite may be made by mixing amorphous carbon and graphite. Semigraphite blocks having a λ-value of for instance 15 kcal/m.h.° C. may easily be obtained.

A cause of many of the problems with blast furnace bottoms is an increasing tendency in modern blast furnaces for larger dimensions and more stringent operating conditions. With larger furnace bottoms, hollows are found in the angle between the bottom and the hearth after a campaign. It has been found that a further improvement in the bottom structure of the invention as described above can be obtained if the covering layer ends within the diameter of the hearth and the graphite layer continues to beneath the furnace wall and has above it first a graphite lining and second a lining with a λ-value of ≧20 kcal/m.h.° C. This last material can also be semi-graphite. With such a design, the bottom behaves thermally like a smaller bottom, while as a result of improved cooling along the hearth wall the angle between the bottom and the hearth lining is subject to less fluctuation in temperature.

BRIEF DESCRIPTION OF THE DRAWING

The preferred embodiment of the invention will now be described by way of non-limitative example with reference to the accompanying drawing, in which the single figure is a vertical diametral section of the bottom and lower wall part of a blast furnace embodying the invention.

DESCRIPTION OF THE PREFERRED EMBODIMENT

The drawing shows the furnace armour 1 of the hearth of the blast furnace and its bottom plate 2. Not shown are the means for spray cooling of the hearth armour 1 and for air cooling of the bottom plate 2, since these cooling means are in general known and do not need description here.

Above tap holes 3 and at 5 around a blow pipe 4 built into the hearth wall is a conventional refractory lining construction of appropriate type.

The refractory bottom above the bottom plate 2, and the adjacent hearth lining, will now be described in more detail.

A thin layer 6 of a graphite mass is first applied to the steel bottom plate 2 in order to guarantee good heat contact between the bottom plate and the lowermost layer 7 of the bottom lying on it. This first layer 7 consists of a conventional carbon material with a λ-value 4 to 5 kcal/m.h.° C. On top of this there is a graphite layer 8, which adjoins the graphite constructions 9 and 10 in the wall lining of the hearth which extends to the exterior of the furnace so that its outer peripheral part lies beneath the hearth wall above the bottom. This outer peripheral part carries an annular layer 9 of graphite, above which is an annular layer 11 of semi-graphite having a λ-value of more than 20 kcal/m.h.° C. This layer 11 is at the transition from the bottom to the hearth wall and, with the layer 9 is surrounded by the lower part 10 of the hearth armour. Within the graphite ring 9 is an intermediate layer 12 of semi-graphite with a λ-value of 15 kcal/m.h.° C., this layer 12 in turn being covered by a high-$Al_2O_3$ containing layer of firebrick 13. (λ-value about 2 kcal/m.h.° C.). The layer 13 is the effective top layer of the bottom, though there is shown a so-called wearing lining 14, which disappears shortly after the blast furnace has blown in. It can be seen that the peripheral edge of the layers 12 and 13 lies within the internal diameter of the hearth wall.

The drawing is not to scale and does not show clearly that the thickness of the graphite layer 8 is 45–50% of the total thickness of the three layers 8, 12 and 13. The thickness of layer 12 is 20% of that total thickness.

The operation and functions of the various layers of the bottom have been described above in full.

What is claimed is:

1. In a shaft furnace having a bottom and a furnace wall extending upwardly from the bottom, the bottom having a plurality of layers of refractory materials, which layers comprise a graphite layer, above the graphite layer an intermediate layer of material having a λ-value (coefficient of thermal conductivity) lower than that of the material of the graphite layer, and above the intermediate layer a third layer of material having a λ-value which is of not more than 4 kcal/m.h.° C. and is lower than that of the material of the intermediate layer, the improvement that:

the λ-value of the material of said intermediate layer is in the range 12 to b 30 kcal/m.h.° C.

2. A shaft furnace according to claim 1 wherein the λ-value of said intermediate layer in an unimpregnated form is of the order of 15 and wherein when during operation of the furnace, said intermediate layer becomes impregnated with molten metal, its λ-value does not substantially increase from its λ-value when unimpregnated.

3. A shaft furnace according to claim 1 or claim 2 wherein the λ-value of the material of said intermediate layer is in the range 12 to 17 kcal/m.h.° C.

4. A shaft furnace according to claim 1 wherein said furnace has at its lowermost inside level a predetermined peripheral edge, and wherein said third layer does not extend substantially beyond said peripheral edge and wherein said graphite layer does extend beyond said peripheral edge to a furnace wall region to form an annular extension, said annular extension having superposed thereon, a first annular layer of graphite and a second upper annular layer of material having a λ-value of not less than 20 kcal/m.h.° C.

5. A shaft furnace according to claim 4 wherein said annular layer of material having a λ-value of not less than 20 kcal/m.h.° C. is semi-graphite.

6. A shaft furnace according to any one of claims 1, 2 and 4 wherein the material of said intermediate layer is semi-graphite.

7. A metallurgical shaft furnace having a bottom comprised of a plurality of refractory material layers, and a furnace wall extending upwardly from said bottom, said layers of the bottom comprising, in upward sequence, (i) a graphite layer (ii) a layer of material which has a λ-value (coefficient of thermal conductivity) in the range 12 to 30 kcal/m.h.° C. and is selected such that, when impregnated with molten metal during operation, of the furnace, its λ-value does not increase substantially from its λ-value prior to such impregnation, and, (iii) a layer of material having a λ-value of not more than 4 kcal/m.h.° C.

8. A furnace according to claim 7 wherein said layer (iii) is semi-graphite.

9. A furnace according to claim 7 or claim 8 wherein the thickness of layer (i) is in the range 45 to 50% of the total thickness of layers (i), (ii), and (iii), and the thickness of layer (ii) is about 20% of said total thickness.

* * * * *